United States Patent [19]

Chappell

[11] Patent Number: 4,524,701

[45] **Date of Patent: * Jun. 25, 1985**

[54] DETACHABLE CAR SEAT TABLES

[76] Inventor: Austin W. Chappell, 739 E. First South, Kaysville, Utah 84037

[ * ] Notice: The portion of the term of this patent subsequent to Nov. 16, 1999 has been disclaimed.

[21] Appl. No.: 412,173

[22] Filed: Aug. 27, 1982

[51] Int. Cl.[3] ..... A47B 23/00; A47B 37/00

[52] U.S. Cl. ..... 108/44; 108/97; 224/42.44; 224/275; 248/157; 248/216.1; 297/188

[58] Field of Search ..... 108/44, 43, 97; 312/235 A; 248/157, 217.3, 216.1, 551; 297/188, 194, 252; 224/42.43, 42.44, 275

[56] References Cited

U.S. PATENT DOCUMENTS

| | | | |
|---|---|---|---|
| 369,210 | 8/1887 | Slipher et al. | 108/97 |
| 559,015 | 4/1896 | Wilmont | 248/216.1 X |
| 1,605,567 | 11/1926 | Sexton | 248/157 |
| 2,569,729 | 10/1951 | Nold | 108/97 |
| 2,897,974 | 8/1959 | Cook | 108/44 X |
| 3,163,287 | 12/1964 | Barnett | 108/44 |
| 3,330,227 | 7/1967 | Yachuk | 108/44 |
| 3,345,118 | 10/1967 | Cummings | 108/44 |
| 3,690,724 | 9/1972 | Douglas et al. | 108/44 X |
| 3,939,986 | 2/1976 | Pierro | 108/44 X |
| 4,095,533 | 6/1978 | Leveille | 224/275 X |
| 4,174,669 | 11/1979 | Lalonde | 108/44 |
| 4,300,709 | 11/1981 | Page, Jr. | 224/275 |
| 4,359,004 | 11/1982 | Chappell | 297/188 X |
| 4,371,138 | 2/1983 | Roberts | 108/44 X |

FOREIGN PATENT DOCUMENTS

| | | | |
|---|---|---|---|
| 247664 | 3/1947 | Switzerland | 248/216.1 |

*Primary Examiner*—Francis K. Zugel
*Assistant Examiner*—Thomas A. Rendos
*Attorney, Agent, or Firm*—Thorpe, North & Western

[57] ABSTRACT

A removable car seat table which may be temporarily secured to the carpet on the floor of an automobile and particularly to the carpet covering the hump housing the drive train on the floor of an automobile. The table comprises a tray section, the rear portion of which rests in the upper surface of a car seat, the forward portion of the tray section being supported by a vertical support member telescopically and frictionally secured between said tray section and a lower attachment section, said attachment section comprising a horizontal base plate having opposing laterally adjustable sidewings containing inwardly projecting slanted teeth on said sidewings. The sidewings are laterally adjusted to be sandwiched on either side of the hump such that the teeth penetrate the carpet covering the hump preventing upward, horizontal or rotational movement of the attachment means. The tray section contains a rim to prevent spillage and also contains one or more apertures in the forward portion thereof to hold beverage cups or cans and condiments to prevent spillage. The attachment means may also be utilized to secure other objects to bases that can be penetrated by the slanted teeth.

9 Claims, 7 Drawing Figures

DETACHABLE CAR SEAT TABLES

BACKGROUND OF THE INVENTION

1. Scope of Invention

The present invention relates to car seat tables. More specifically, this invention relates to a car seat table one end of which may be temporarily but fixedly secured to a carpet in front of a seat in an automobile and particularly to the carpet covering the drive train hump of an automobile with the other end of the table resting on the upper surface of the car seat.

2. Prior Art

Automobiles are used both for short excursions and for longer trips and many people eat while driving in the car. To the driver this may present a problem as he must pay attention to the road and driving conditions as well as trying to eat and drink without spilling on himself. Many cars with bucket seats have trays or shelves positioned between the front bucket seats on which may be placed items of food and drink. However, such trays or shelves are typically permanently installed and may only be removed by undoing screws, bolts, or similar fastening devices.

In U.S. Pat. No. 4,341,418 issued July 27, 1982, a sectionalized car seat table which slides on a track mounted under a bench seat of an automobile is disclosed. This table can be stored under the seat and folds up and over the seat of the car when assembled. The table requires a permanently attached track and interconnected foldable sections. In copending application Ser. No. 295,789 filed Aug. 24, 1981 is disclosed a car seat which is an adaptation of the seat disclosed in U.S. Pat. No. 4,341,418. This car seat table has a foldable tray section but does not store under the seat. Rather, it is frictionally secured at one end to the floor of the automobile in front of the seat with the other end resting on the seat. The portion of the car seat table resting on the floor is weighted to increase friction and restrain the table from upward or lateral movement. The tables disclosed and the patents cited in the above mentioned patent and copending application are believed to represent the most relevant prior art to the present invention.

OBJECTS AND SUMMARY OF THE INVENTION

It is an object of the present invention, in accordance with one embodiment thereof, to provide a food and drink retainer or table which is temporarily attachable to the carpet forward of the seat and particularly to the carpet covering the hump of the drive train on the floor of an automobile.

It is a further object of the present invention to provide such a table for car seats which may be quickly and easily installed and temporarily secured against upward, lateral, and rotational movement.

It is an additional object of the present invention to provide a car seat table that is attachable to the carpet on the car floor forward of the car seat and that may be temporarily secured thereto against movement without the use of weights, screws, bolts, or similar fastening devices.

These and other objects of the invention are realized by a table consisting of (1) a unitary tray section, (2) an adjustable riser or support section, and (3) an attachment section.

In its preferred embodiment, the tray section of the table is supported at the forward end at the underside thereof with a substantially verticle riser or support member, having a selective height, that rises up from the attachment section that is temporarily secured to the carpet on the car floor. The attachment section includes anchoring means for securing it in a desired position, to the carpet and particularly to the carpet covering the hump housing the drive train on the floor of the car, and which anchoring means does not require the use of fastening devices, such as screws or bolts. Rather an attachment section consisting of a horizontal base plate having lateral adjustable sidewings which may rest on a flat floor or be adjusted to grip either side of the carpet covering of the hump of the drive train of an automobile are used. Each sidewing contains a multiplicity of projecting pointed teeth that are slanted at an angle and penetrate the carpet to secure the attachment section from upward, rotative, or horizontal movement. The rear section of the tray may be supported at the underside thereof with suitable support structure that elevates the rear portion to a desired height or the rear portion of the tray may rest directly upon the seat.

BRIEF DESCRIPTION OF THE DRAWINGS

The above and other objects, features, and advantages of the invention will become more apparent from the following more particular description presented in connection with the accompanying drawings, in which.

Figure 1:
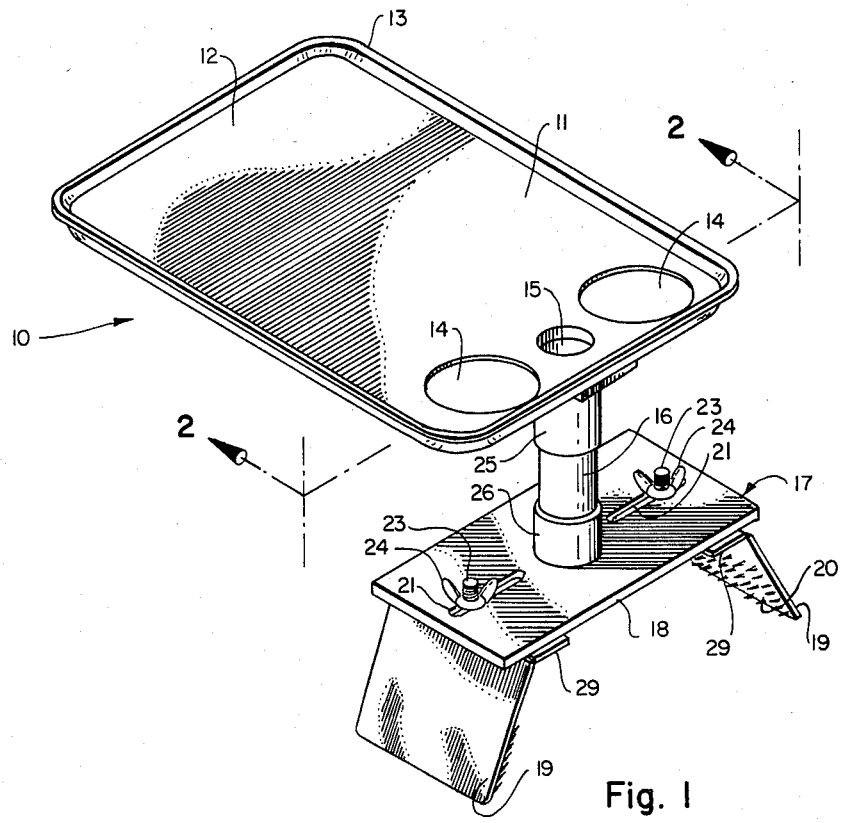
FIG. 1 is a pictorial view of one embodiment of the car seat table of the present invention in an unattached position.

There is shown in FIGS. 1–5 a complete embodiment of the present invention describing a removable car seat table 10 that may be temporarily secured in a desired position to a carpet on the floor of an automobile without the use of screws, bolts, or similar fastening devices. In this embodiment, a one piece tray section 11 includes floor 12 surrounded by a rim 13. The front portion of the tray contains one or more cup holding apertures 14 and one or more apertures 15 for holding condiments and the like. The rim 13 surrounds the outer perimeter of the tray floor 12 and to prevent spillage onto the car seat. The cup-holding apertures 14 are sized to hold beverage containers or cans and the like and to keep them from spilling. If desired, aperture 14 may be adapted with proper support means, such as a bracket, to hold beverage cans or bottles instead of cups.

The tray section 11 of the table unit 10 is supported on the underside thereof with a riser or support member 16. One end of support member 16 attaches to an attachment section 17, while the other end is attached to a first tubular member 25 located on the underside of the tray section 11. In a preferred embodiment, the support member 16 is adjustable in height, there being a second tubular member 26 attached to the base plate 18 of attachment section 17. Support member 16 may be telescopingly inserted into tubular members 25 and 26 and frictionally held in any height adjustment. Locking means may also be provided in order to hold the support member 16 at a desired height with respect to the tray 11 once the desired height has been obtained. Alternatively, if the removable car seat table 10 shown in FIGS. 1–4 is to be used in only one vehicle, the support member 16 may be cut to a desired height compatible with a car seat so that the lower end of support member 16 bottoms out within the tubular members 25 and 26 at the desired height.

The attachment section 17 consists of a generally rectangular base plate 18 and opposing laterally adjustable sidewings 19. Sidewings 19 are preferably unitary with flat upper and lower sides, the forward portion being a base plate engaging section 29 and the rear portion being the carpet engaging section 30.

Base plate 18 contains elongated apertures 21 extending in the direction of the longitudinal axis. An aperture 22 is contained in the base plate engaging section 29 of sidewing 19. The upper surface of sidewing 19 underlies the lower surface of base plate 18 such that apertures 21 and 22 are in alignment. A bolt 23 extends through the aligned apertures and is secured by a wingnut 24. By loosening wingnut 24 sidewing 19 may be laterally adjusted along elongated aperture 21 in base plate 18 and secured in any desired position by tightening wingnut 24.

Figure 2:
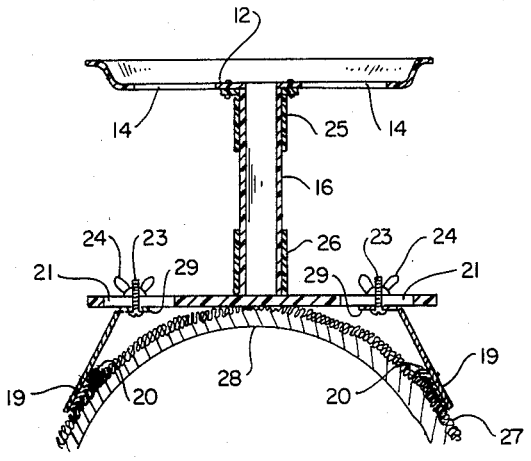
FIG. 2 is a front cross-section view taken along lines 2—2 of FIG. 1 of a table positioned over and secured to the carpet covering the hump of the drive train of an automobile showing the configuration of the teeth and the adjustable configuration of the riser or support section.

The carpet engaging section 30 of sidewing 19 may be in the same horizontal plane as the base plate engaging section 29 but preferably is angled generally downwardly and slightly outwardly as shown in FIGS. 1 and 2. Preferably the opposing carpet engaging sections 30 depend outwardly at an angle of about 5 to 35 degrees away from being vertical.

Figure 3:
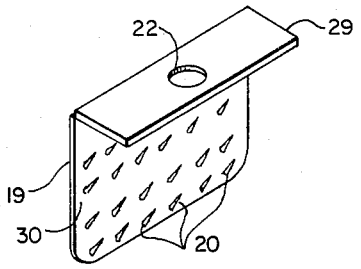
FIG. 3 is a pictorial view of a sidewing of an attachment section from FIGS. 1 and 2 showing the teeth arranged in rows.
Figure 4:
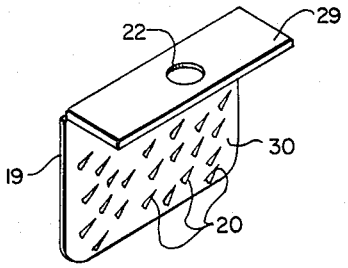
FIG. 4 is a pictorial view of a sidewing of an attachment section from FIGS. 1 and 2 showing the teeth in a random pattern.

Pointed teeth 20 projecting from the inside surface of the carpet engaging section 30 of sidewings 19 are slanted. These slanted teeth are generally shaped like sharks teeth and are arranged in rows as shown in FIG. 3. However, they can also be randomly arranged as shown in FIG. 4.

Figure 5:
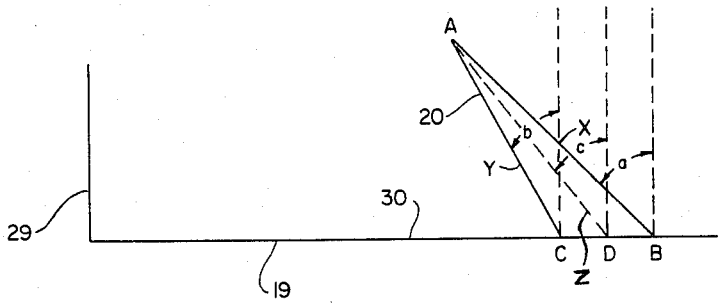
FIG. 5 is an exaggerated enlarged side view of one of the teeth shown in FIGS. 3 and 4 illustrating the angle of incline.

By sharks teeth is meant slanted projections which are in the shape of an irregular cone as shown in FIG. 5. The slant height X from the base B to the vertex A on the side of the teeth away from the section 29 is greater than the slant height Y from the base C to the vertex A on the side closest the Section 29. Thus, the angle of incline a of each tooth surface on the side away from the section 29 is greater than the opposing angle of incline b on the surface of the opposite side. The angle of incline c of a line Z extending from the center D of the base of the tooth to the vertex A may vary from about 5 to 35 degrees with angles of 10 to 30 degrees being preferred. Because teeth 20 project outwardly and are slanted back toward section 29, they penetrate the carpet 27 covering the hump 28 of the drive train of an automobile when the sidewings 19 are laterally adjusted in base plate 18 to rest against the carpet 27, and hold the attachment section in a secured position. In this secured position the slanted teeth 20 penetrate carpet 27 and prevent the attachment section 17 from upward, horizontal or rotational movement. The support member 16 is adjusted in tubular means 25 and 26 such that the rear portion of tray 11 rests on the surface on the car seat when the table 10 is positioned in the car.

The table is removed by gently pulling the sidewings 19 outwardly disengaging teeth 20 from the carpet 27. If necessary, wingnuts 24 may be loosened to allow sidewings 19 to be moved outwardly to disengage teeth 20.

Figure 6:
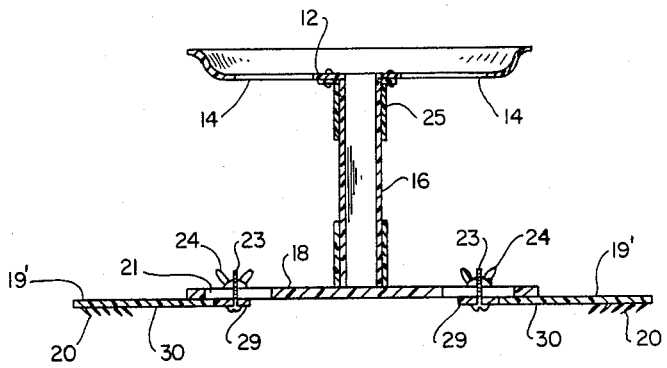
FIG. 6 is a front cross-section view of a car seat table similar to FIG. 2 showing a second embodiment of the invention in an unattached position wherein the sidewings extending laterally outwardly instead of extending downwardly as in FIG. 2.

FIG. 6 shows an alternate embodiment of the invention adapted for useage in front wheel drive vehicles having flat floors instead of a hump to house a drive train. In that embodiment all parts remain the same as already described with the exception of sidewings 19' which are linear and do not contain a bent base plate engaging section 29 as shown in FIG. 2. In this embodiment, teeth 20 are still inclined toward section 29. However, to obtain maximum penetration of teeth 20 into the carpet, it may be necessary to loosen wingnut 24 on either side of base plate 18 once the table has been positioned on the carpet and slide both sidewings 19' toward each other. In this embodiment the table will be secured from lateral movement but will not be as secure from upward movement. However, since the primary tendency is toward lateral movement, such as when an automobile is negotiating a turn, the table still remains in a stationary position.

A rear support member (not shown) may be affixed to the underneath side of the tray 11. Preferably, this support member is a cylindrical tube that is affixed tangentially to the underside of the rear tray section 11. The diameter or width of the support member is selected so that the table section is substantially level with the forward portion of the tray section resting on the tip or front of the seat.

The support member 16, as well as the tubular support means 25 and 26, may advantageously be realized using commercially available PVC plastic pipe or the equivalent. Such pipe is readily available in convenient sizes and is inexpensive. Moreover, if a $1\frac{1}{2}$-inch PVC pipe is used to realize the tubular means 25 and 26, then a $1\frac{1}{4}$-inch PVC pipe may be used for the support member 16, and such support member will just fit inside of the $1\frac{1}{2}$-inch pipe, thereby providing the desired telescopic adjustment.

The entire tray section 11 including tubular means 25 may be molded as a unitary unit from any suitable plastic. The attachment section 17 may be made entirely of plastic, metal, or a combination of plastic and metal. Preferably base plate 18 and tubular means 26 are molded as a unitary unit.

The table disclosed herein may be adapted for uses other than in an automobile. For example, opposing sidewings 19 may be moved sufficiently close together to enable the table to be secured to the arm of a sofa or upholstered chair.

Figure 7:
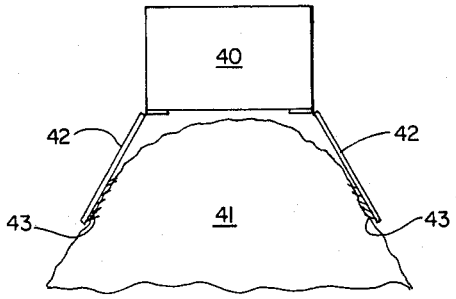
FIG. 7 is a cross-sectional view of a generalized application of the attachment means of the invention illustrating the attachment of any item to any base of substrate which can be penetrated by the teeth on the sidewings.

The combined opposing sidewings and projecting teeth may also be used as attachment means for objects other than car seat tables. In FIG. 7, box 40 may refer to any article which may be anchored or secured to any base 41 by means of sidewings 42 and projecting sharksteeth 43 in the manner above described. Box 40 could refer to a saddle or pack secured to a base 41, i.e., a blanket or pad, on the back of a horse or other pack animal. Similarily, protective covers on arms of sofas may be anchored. Other items such as tool trays or cassette or 8-track tape trays may be achored in front of the seat of an automobile. In view of the above description and examples, it is apparent that sidewings 42 containing sharksteeth 43 may be used as a general anchoring means for any item 40 to a base 41. In the place of a base plate 18 as previously described, sidewings 42 may be attached to item 40 in any conventional manner such as sewing, bolts, screws, rivets, snaps and the like. The attachment may be adjustable or permanent. Sidewings 42 may be of any suitable material such as plastic, fabric or metal, and sharksteeth 43 may be made of plastic or metal and be an integral part of sidewings 42 or removably or permanently attached thereto.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

I claim:

1. A car seat table assembly comprising:

(a) a lower attachment section consisting of a generally rectangular, horizontal base plate having attached thereto a pair of opposing laterally adjustable sidewings, each sidewing having outer and inner surfaces, a forward base plate engaging section and a rearward carpet engaging section, the inner surface of each carpet engaging section containing a multiplicity of projecting pointed teeth which teeth are slanted back at an angle in the direction of the forward base plate engaging section, said base plate containing on the upper surface thereof upwardly extending tubular support means for telescopically receiving a vertical support member, (b) a generally rectangular tray section having a horizontal floor surrounded by an upwardly extending rim, the forward portion of said tray section containing a plurality of apertures for receiving and holding liquid food containers, the lower surface of the forward portion of said tray section containing downwardly extending tubular support means for telescopically receiving a vertical support member, and (c) a vertical support member adjustably and frictionally secured in said upwardly and downwardly extending tubular support means of said attachment and tray sections.

2. A car seat table according to claim 1 wherein said base plate contains elongated apertures in the direction of the sidewings, the base plate engaging section of said sidewings containing apertures which are in alignment with the elongated apertures in the base plate and wherein fastening means extend through the aligned apertures in said base plate and sidewings to fixedly secure said sidewings to said base plate in a position of lateral adjunctment.

3. A car seat table according to claim 2 wherein said projecting pointed teeth are slanted backward from right angles toward the base plate engaging section of the sidewings at an angle of between about 5 to 35 degrees.

4. A car seat table according to claim 3 wherein each slanted tooth is in the shape of an irregular cone such that the slant height from the base to the vertex is greater on the side of the tooth away from the base plate engaging section than the slant height on the side facing the base plate engaging section.

5. A car seat table according to claim 4 wherein said sidewings consist of a horizontal base plate engaging section and a generally downwardly extending carpet engaging section.

6. A car seat table according to claim 5 wherein each downwardly extending carpet engaging section of said sidewings is angled outwardly at an angle of between about 5 to 35 degrees from a vertical position.

7. A car seat table according to claim 6 wherein the slanted teeth are arranged in rows on the inner surface of the carpet engaging section of the sidewings.

8. A car seat table according to claim 6 wherein the slanted teeth are randomly arranged to the inner surface of the carpet engaging section of the sidewings.

9. A car seat table according to claim 4 wherein said sidewings consist of a unitary, horizontally aligned base plate engaging section and carpet engaging section.

* * * * *